United States Patent [19]

Nonnenmacher

[11] Patent Number: 4,518,322

[45] Date of Patent: May 21, 1985

[54] ARRANGEMENT FOR REGULATING A SUPPLY FLOW AND FOR LIMITING A SUPPLY PRESSURE OF AN ADJUSTABLE PUMP

[75] Inventor: Gerhard Nonnenmacher, Korntal, Fed. Rep. of Germany

[73] Assignee: Robert Bosch GmbH, Stuttgart, Fed. Rep. of Germany

[21] Appl. No.: 95,925

[22] Filed: Nov. 19, 1979

[30] Foreign Application Priority Data

Feb. 17, 1979 [DE] Fed. Rep. of Germany ..... 2906166

[51] Int. Cl.[3] ..... F04B 1/26

[52] U.S. Cl. ..... 417/222; 417/218

[58] Field of Search ..... 417/216-222; 60/445-452

[56] References Cited

U.S. PATENT DOCUMENTS 3,700,356 10/1972 Kubik ..... 417/222
3,722,366 3/1973 Richardson ..... 60/445
4,067,664 1/1978 Robeller ..... 417/218
4,194,364 3/1980 Pahl et al ..... 60/445

*Primary Examiner*—Edward K. Look
*Attorney, Agent, or Firm*—Michael J. Striker

[57] ABSTRACT

An arrangement for regulating supply flow and limiting supply pressure of an adjustable pump, has a flow regulating valve, a control spring and a throttling element for controlling the flow regulating valve and arranged so that a primary pressure takes place upstream and a secondary pressure takes place downstream of the throttling element so as to form a pressure differential, an adjusting member operative for adjusting the pump and controllable by the throttling element, a servo element operative for forming communication with a pressureless space in the event when the supply pressure exceeds a predetermined value so that the pump is adjusted back to a smaller supply, as second throttling element arranged to bring the secondary pressure to the flow regulating valve, and a third throttling element arranged to vary the secondary pressure, connected in series with the servo valve, and first operating when the latter is open.

3 Claims, 4 Drawing Figures

ARRANGEMENT FOR REGULATING A SUPPLY FLOW AND FOR LIMITING A SUPPLY PRESSURE OF AN ADJUSTABLE PUMP

BACKGROUND OF THE INVENTION

The present invention relates to an arrangement for regulating a supply flow and for limiting a supply pressure of an adjustable pump.

Arrangements of the above-mentioned general type are known in the art. In a known arrangement, a pressure differential acting upon a flow regulating valve is brought about by two throttling elements connected in series. One of the throttling elements is arranged in a supply conduit, whereas the other throttling element is arranged in a branching off conduit. Such a construction has a disadvantage in the fact that when a small excess of the pressure in the system or an untightness of a servo valve take place, a flow starts to travel through the throttling element arranged in the branching off conduit. Thereby the pump is set back exactly to such extent that the pressure drop at this throttling element is compensated by a small pressure drop at the throttling element in the supply conduit. This causes a transition region of pressure through which the supply flow slowly decreases. Thereby, the decrease of the supply flow can extend through a substantially greater pressure region than it is desired. In this case when the working pressure reaches its maximum value, strong deviations of the supply flow value take place.

SUMMARY OF THE INVENTION

Accordingly, it is an object of the present invention to provide an arrangement which avoids the disadvantages of the prior art.

More particularly, it is an object of the present invention to provide an arrangement for regulating a supply flow and for limiting a supply pressure, which has the advantage that it allows to improve the condition of regulation of a flow regulatable and pressure regulatable pump, for example, by the fact that the pressure variations of a consumer do not completely act upon a regulating valve.

This allows to design the regulating valve for a very high sensitivity without making the pressure regulation process unstable. A small measuring pressure is also required which results in small output losses in the system. It is especially advantageous that this can be attained by only one regulating valve.

In keeping with these objects and others which will become apparent hereinafter, one feature of the present invention resides, briefly stated, in an arrangement which has a flow regulating valve, means for controlling the flow regulating valve and including a control spring and a throttling element through which the supply flow passes with a primary pressure upstream and a secondary pressure downstream of the throttling element so as to form a pressure differential, an adjusting member operative for adjusting the pump and controllable by the throttling element, and a servo valve operative for forming communication with a pressureless space in the event when the supply pressure exceeds a predetermined value so that the pump is adjusted back to a smaller supply, in which arrangement a second throttling element is arranged to bring the secondary pressure to the flow regulating valve, and a third throttling element is arranged to vary the secondary pressure and connected in series with the servo valve and first operating when the latter is open.

In accordance with other features of the present invention, the third throttling element may be adjustable. The third throttling element may be connected with the second throttling element in series and arranged downstream of a conduit which operatively connects the second throttling element with the flow regulating valve. A spring-biased valve may be arranged parallel to the third throttling element so as to bypass the latter. A return valve may be arranged between the first and second throttling elements downwstream of the flow regulating valve so as to be openable in direction from the second to the first throttling element. The first and second throttling elements may be arranged parallel to or in series with the flow regulating valve. Finally, the third throttling element may also be adjustable.

The novel features which are considered as characteristic as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
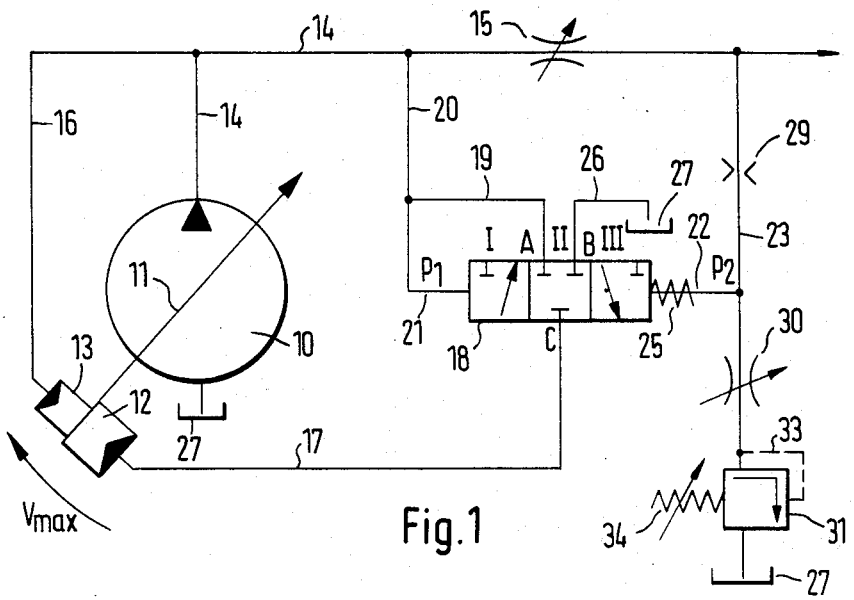
FIGS. 1–4 schematically show a regulating arrangement for an adjustable pump in accordance with several embodiments of the present invention.

An adjustable pump is identified in the drawing by reference numeral 10. It has a control number 11 which is adjusted by two pressure loaded oppositely acting pistons 12 and 13. Such control arrangements are known in the art. The pump 10 has a supply conduit 14 in which an adjustable throttle 15 is arranged. A conduit 16 branches off from the supply conduit 15 and leads to the piston 13 having a smaller pressure-loaded area than the piston 12. A conduit 17 leads from the latter to a flow regulating valve 18 of a known constriction.

The flow regulating valve 18 can assume three switch positions I, II and III and has three ports A, B and C. A conduit 19 leads from the port A to a conduit 20 which is open into the supply conduit 14 at a location upstream of the throttle 15. A control conduit 21 leads from the conduit 20 to one side of the regulating valve. Another control conduit 22 is located at the opposite side of the same and leads to a conduit 23 which is also open into the supply conduit 14, but at a location downstream of the throttle 15.

At the side of the control conduit 22, the flow regulating valve is loaded by a regulating spring 25. A conduit 26 leads from the port B of the flow regulating valve to a container 27. The pump 10 aspirates pressure medium from this container. A throttle 29 is provided in the conduit 23 upstream of the location at which the conduit 22 opens into the latter. The conduit 23 is provided with an adjustable throttle 30 located downstream of the location at which the control conduit 22 opens into the conduit 23. Downstream of the throttle 30, a servo valve 31 is arranged in the conduit 23. The servo valve 31 is loaded through a control conduit 33 exiting from the conduit 23, against the force of an adjustable spring 34. The conduit 23 opens below the servo valve 31 into the container 27.

Pressure which takes place in the supply conduit 14, acts through the conduit 16 onto the piston 13. A definite pressure differential generates in the throttle 15 by flow of pressure medium. The primary pressure p upstream of the throttle 15 acts through the control conduit 21 upon the left side of the flow regulating valve 18. The secondary pressure $p_2$ downstream of the throttle 15 acts through the conduit 23 and the control conduit 22, upon the right side of the flow regulating valve 18 from which the regulating spring 25 is also actuated. When the pressure differential at the throttle 15 exceeds (because of increase or the supply flow) the fixed force of the regulating spring 5, the flow regulating valve moves from its blocking position II to its position I. Thereby, pressure medium can flow from the piston 12 through the conduits 17 and 26 into the container 27, whereby the pressure on the piston 12 decreases. The force of the piston 13 prevails, the control member 11 is actuated back, and the pump is adjusted so as to provide a smaller supply of pressure medium.

When the pressure differential, in contrast is smaller because of small supply of pressure medium, the spring 25 displaces the flow regulating valve to its position 14. In this position pressure medium travels through the conduits 20, 19, 17 to the piston 12 of greater area so that the pump is adjusted for a greater supply of pressure medium.

When working pressure in the supply conduit 14 is below the control pressure of the flow regulating valve 31, the regulating arrangement operates as a conventional flow regulating arrangement. When, in contrast, the working pressure reaches the response pressure of the servo valve 31, that is the latter is brought in its passage position by pressure acting in the conduits 23 and 33 against force of the spring 34, the pressure medium flow passing through the conduit 23 travels through the servo valve to the container 27. At this moment the throttles 29 and 30 will operate. Pressure downstream of the throttle 29 which is equal to the pressure downstream of the throttle 15 in condition of the closed servo valve 31 decreases to a magnitude which is defined by the throttle 30. In the conduit 23, the decrease of pressure also takes place which decrease is predetermined by the throttle 30. Thus now not only the pressure differential of the throttle 15 acts controllably onto the flow regulating valve 10, but also that defined in cooperation with the throttle 30.

Because of the pressure decrease in the conduit 23, pressure acting in the conduit 20 and the control conduit 21 displaces the flow regulating valve into its switch position I, after which the pump is set back as described above. By the action of the throttle 30 it is provided that pressure variations in the supply conduit 14 act in reduced manner upon the flow regulating valve 18 with a predetermined division ratio. This allows to design the flow regulating valve with a very high sensitivity which simultaneously requires a small measuring pressure and result in small losses in connection therewith, without making the pressure regulation instable.

When the pressure downstream of the throttle 30 respectively declines, the spring 34 urges the servo valve 31 again into its blocking position, so that, in accordance with the pressure acting in the conduit 9–23, the flow regulating valve may again be brought into its switch positions II or III.

Figure 2:
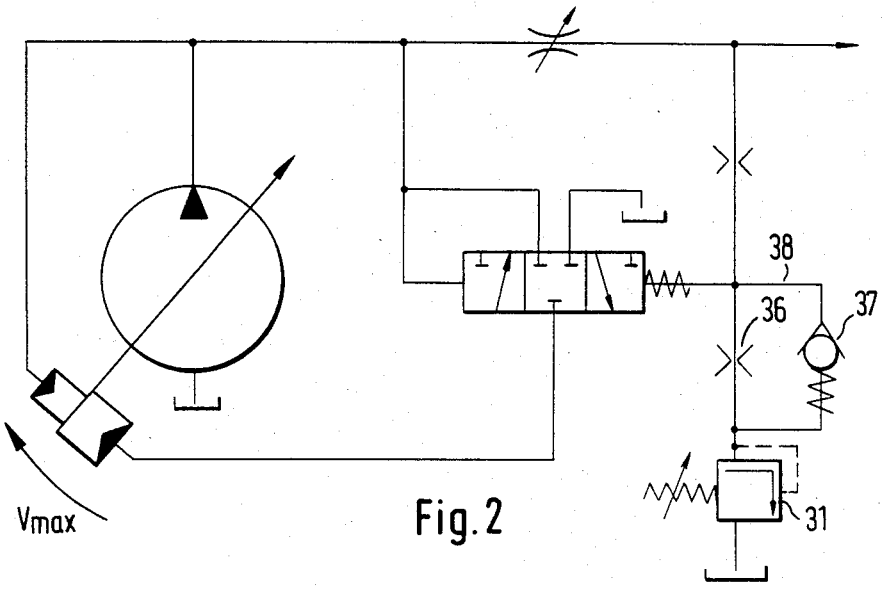

The arrangement in accordance with the embodiment shown in FIG. 2 differs from the arrangement of FIG. 1 in that the third throttle is formed as a permanent throttle identified by reference numeral 36. A prestressed valve 37 is arranged parallel to the permanent throttle 36. It is located in a by-pass conduit 38 for the throttle. In such a construction, when pressure peaks occur in the supply conduit, the action of the throttle 36 is reduced which leads to an extremely fast response of the servo valve 31 and thereby to the regulating back of the pump into direction of zero supply. Moreover, this construction reduces the minimum adjustable regulating pressure.

Figure 3:
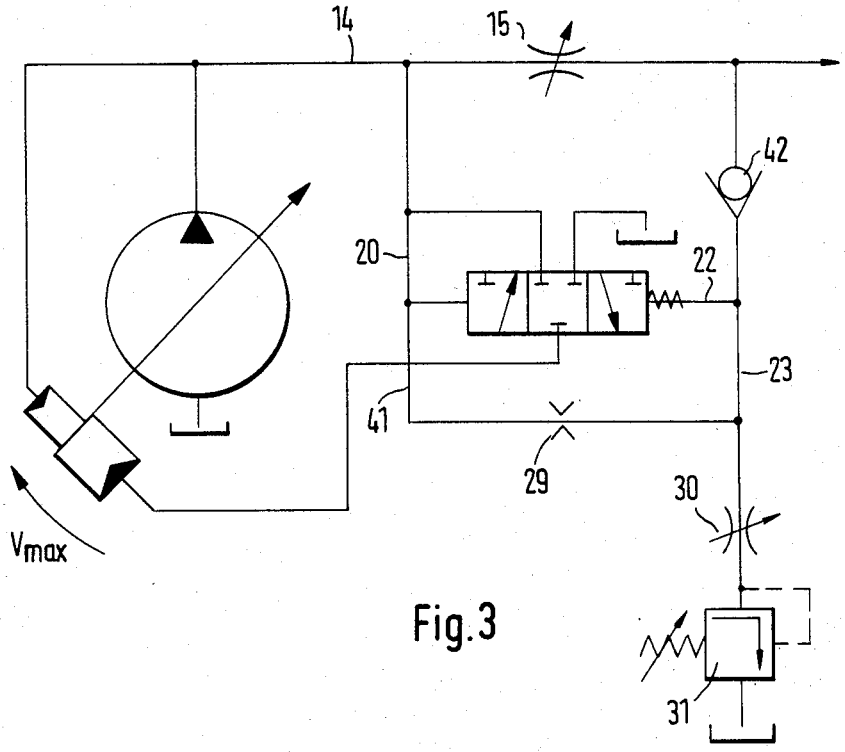

In the arrangement in accordance with the embodiment of FIG. 3, the throttle 15 and the second throttle 29 are connected parallel with each other. The latter is located in a conduit 41 which extends from the conduit 20 and leads to the conduit 23 in which a return valve 42 is provided. The latter is arranged between the location at which the control conduit 22 opens into the conduit 23 and the outlet of the conduit 23, and upstream of the supply conduit 14. It can be open in direction toward the supply conduit 14. Downstream of the location at which the conduit 41 opens into the conduit 23, the servo valve 31 is again arranged. The adjustable throttle of FIG. 1 is located between the servo valve 31 and the above-mentioned location.

Figure 4:
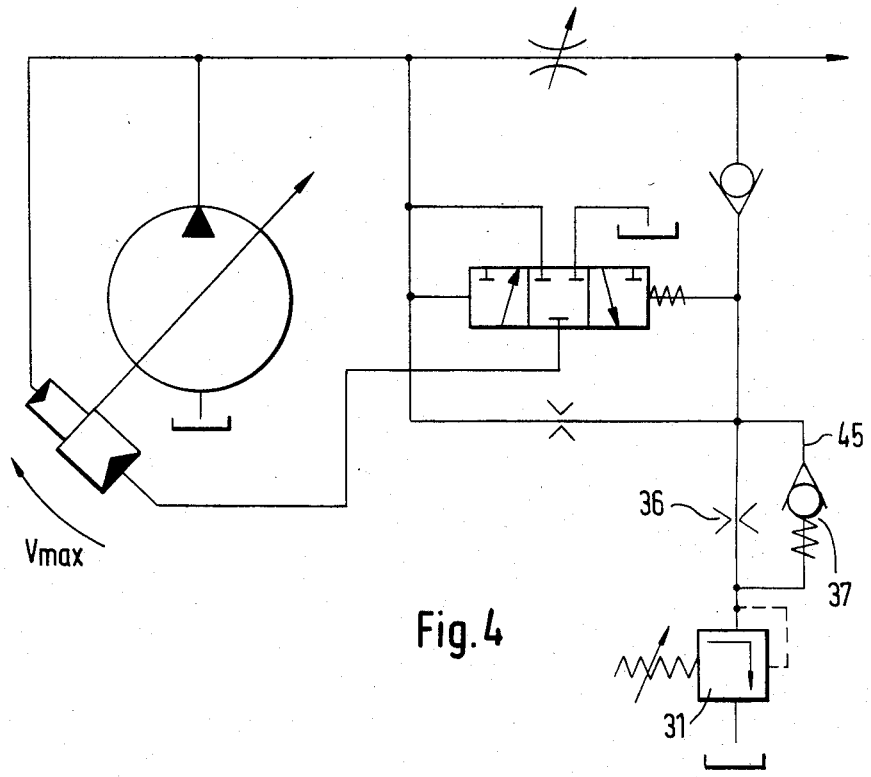

The adjustable throttles 30 of the arrangements shown in FIGS. 1 and 3 allow to adjust different regulating sensitivities for regulation of pressure, which cannot be performed in the arrangements shown in FIGS. 2 and 4. The latter arrangements, however, have the advantages in that they have different regulation sensitivities for flow regulation and pressure regulation. They also have the additional advantage in the fact that when pressure peaks take place, the action of the throttle 23 diminishes which leads, as explained above, to an extremely fast setting back of the pump. Moreover, the minimum controllable regulating pressure is reduced in those constructions.

The arrangement in accordance with the embodiment of FIG. 4 differs from the arrangement of FIG. 3 in that the third throttle is again formed as a permanent throttle 36 and arranged parallel to the prestressed valve 37 located in a conduit 45. The operation of such a construction is described above.

The flow cross section of the inventive throttles 30 and 37 is, for providing the intended action, generally smaller than that of the throttle 29.

It will be understood that each of the elements described above, or two or more together, may also find a useful application in other types of constructions differing from the types described above.

While the invention has been illustrated and described as embodied in a construction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for regulating supply flow and limiting supply pressure in a supply conduit means of an adjustable pump, comprising an adjusting member coupled to said pump and having a first inlet and a second inlet for a pressure fluid; first throttling element in the supply conduit; a flow regulating valve having a common port, a first switching port connected to the supply conduit upstream of the first throttling means and a second switching port connected to a tank; a non-return valve connecting one end of the flow regulating valve to said supply conduit downstream of the first throttling means, said one end being biased by a spring to displace the valve into a first working position in which the first switching port is connected to the common port, and the other end of the flow regulating valve being connected to said supply conduit upstream of said first throttling element to displace the regulating valve into a second working position in which the common port is connected via the second switching port to the tank; the adjusting member cooperating with said pump and having one inlet connected to said supply conduit upstream of the first throttling element and a counteracting inlet connected to the common control port of the flow regulating valve; a spring biased preliminary control valve having an outlet connected to the tank, and an inlet; a second throttling element connected between said supply conduit upstream of the first throttling means and said one end of the flow regulating valve; and a third throttling element connected between said one end of the flow regulating valve and said inlet of said preliminary control valve.

2. An arrangement as defined in claim 1; and further comprising a spring-biased non-return valve arranged parallel to said third throttling element and by passing the latter.

3. An arrangement as defined in claim 1, wherein said first throttling element and said second throttling element being arranged parallel to said flow regulating valve.

* * * * *